US010962324B1

(12) United States Patent
Ding et al.

(10) Patent No.: US 10,962,324 B1
(45) Date of Patent: Mar. 30, 2021

(54) HANDGUARD AND RELATED METHOD OF USE

(71) Applicant: Leapers, Inc., Livonia, MI (US)

(72) Inventors: Tai-Lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 16/857,541

(22) Filed: Apr. 24, 2020

(51) Int. Cl.
*F41C 23/16* (2006.01)
*F41G 11/00* (2006.01)

(52) U.S. Cl.
CPC ..... *F41C 23/16* (2013.01); *F41G 11/004* (2013.01)

(58) Field of Classification Search
CPC ..... F41C 23/16
USPC ..... 42/70.01, 72
See application file for complete search history.

(56) References Cited

U.S. PATENT DOCUMENTS

| | | | | |
|---|---|---|---|---|
| 6,381,895 | B1 | 5/2002 | Keeney | |
| 8,904,691 | B1 * | 12/2014 | Kincel | F41C 23/16 42/71.01 |
| 9,518,801 | B2 | 10/2016 | Krebs | |
| 9,714,802 | B1 | 7/2017 | Storch | |
| 10,184,753 | B2 * | 1/2019 | Krebs | F16B 2/065 |
| 10,295,304 | B1 * | 5/2019 | Kincel | F41A 21/485 |
| 2005/0021716 | A1 | 1/2005 | Haugen | |
| 2017/0176135 | A1 * | 6/2017 | Fesas | F41C 23/16 |
| 2018/0202759 | A1 * | 7/2018 | Samson | F41A 21/48 |

OTHER PUBLICATIONS https://leapers.com/manual/Manual-Mount-MTU009.pdf, downloaded Apr. 17, 2020.
https://leapers.com/manual/Manual-Mount-MTU010.pdf, downloaded Apr. 17, 2020.
https://www.manualsdir.com/manuals/697959/leapers-pro-yugo-m70-ak-quad-rail-handguard-mtu011.html, downloaded Apr. 17, 2020.
https://www.leapers.com/manual/Manual-Mount-(for%20MTU027SSKA,MTU027SSKC).pdf, downloaded Apr. 17, 2020.
http://sureshot-armament.com/product/ak-handguard-mk1/, downloaded Apr. 17, 2020.
https://www.midwestindustriesinc.com/product-p/mi-akxg2-y70mt1.htm, downloaded Apr. 17, 2020.

(Continued)

*Primary Examiner* — Reginald S Tillman, Jr.
(74) *Attorney, Agent, or Firm* — Warner Norcross + Judd, LLP

(57) ABSTRACT

A handguard and related method are provided. The handguard can include a clamp with opposing ramped surfaces, wedges engaging the ramped surfaces, and fasteners extending through the wedges and opposite sides of the handguard. Rotating the fasteners urges the wedges against the ramped surfaces to urge the clamp and a corresponding clamp element against a barrel to clamp the handguard to it. Where multiple fasteners are included, they can extend in opposite directions over the barrel, and can have reversed locking directions to distribute clamping forces to the barrel evenly. The clamp and wedges can prevent rotation of the handguard and provide parallel upward and downward movement. A fastener can extend through a wedge bore without engaging that wedge bore, while another fastener can threadably engage another wedge bore in the same wedge to provide horizontal wedge movement via rotation of the fastener.

20 Claims, 7 Drawing Sheets

(56) References Cited

OTHER PUBLICATIONS https://www.crook.com.ua/product-page/crc-1u004-basic-anodizing-довга -цівка -для -ак ?lang=en, downloaded Apr. 17, 2020.
https://www.cheaperthandirt.com/troy-industries-ak-47-rail-m-lok-short-bottom-black/FC-812441022073.html, downloaded Apr. 17, 2020.
https://slrrifleworks.com/ak-13-5-mid-mlok-m70-yugo-mount/, downloaded Apr. 17, 2020.
https://www.krebscustomak47.com/products/product/377-krebs-custom-ufm-m-lok-system-for-akm-rifles-long-version, downloaded Apr. 17, 2020.
https://rsregulate.com/product/gkr-10ms/, downloaded Apr. 17, 2020.
https://occamdefense.com/merc-freefloat-handguard/.
https://www.aimsportsinc.com/ak-47-keymod-handguard/.
https://ivantactical.com/shop/weapon-accessories/weapon-rails-and-tuning/lower-handguards/alfa-arms-tis-m-lok-ak-handguard/.

* cited by examiner

HANDGUARD AND RELATED METHOD OF USE

BACKGROUND OF THE INVENTION

The present invention relates to firearms, and more particularly to a handguard assembly that secures a handguard to a firearm.

Many modern sporting and military firearms include a handguard that extends forward and around a barrel of the firearm. The handguard prevents contact between the user and the barrel, thereby protecting the user when the barrel heats up after extended periods of fire. The handguard also can provide one or more rails or other surfaces upon which to mount accessories, such as lights, lasers, grenade launchers and other items.

An issue with many handguards is that they can be difficult to securely and precisely mount to a firearm. Frequently, handguards are provided with screws that tighten against a part of the barrel or some other portion of the firearm. While the screws can hold the handguard in most situations, they can sometimes give way and slide, so that the handguard can rotate, under excessive forces or moments exerted on the handguard, relative to the remainder of the firearm. In turn, this can provide an inadequate grasping surface. In other cases, where the rotation is significant, rails on the handguard can misalign with other rails on the remainder of the firearm. This can be particularly problematic where a sight or laser is mounted on the handguard. As a result of the rotation or misalignment, the firearm can become less accurate or the accessory can be damaged.

Yet further issues for mounting handguards can be present where the firearm is uniquely configured. For example, in an AK-47 type firearm or variants thereof, a cylindrical gas tube extends above the barrel, away from the receiver of the firearm. In this location, the gas tube impairs any access or attachment points to the barrel from its upper part. Thus, many handguards and rails for the AK-47 are secured only to the gas tube, however, this can be an issue because sometimes the gas tubes are not rigid enough and/or can rotate slightly. This can cause any sights or optics to move as well, which can impair the function of the same. Further, upon installation of a handguard or rail on the gas tube, the gas tube, which typically is constructed from thin sheet metal, can become damaged, which can impair operation of the firearm and/or increase a likelihood of malfunction. In addition, some handguards installed over the AK gas tube can be tightened to the tube in such a manner so as to torque the handguard such that it is canted to a left or right side, which affects the alignment of the handguard with the receiver and the aesthetics of the weapon due to the crooked handguard.

Accordingly, there remains room for improvement in the field of handguards, and in particular, the way that they are secured to a firearm to prevent rotation or movement of the handguard, and any associated accessories, relative to the remainder of the firearm.

SUMMARY OF THE INVENTION

A handguard and related method of use are provided. The handguard can include a clamp with opposing ramped surfaces, wedges engaging the ramped surfaces, and fasteners extending through the wedges and opposite sides of the handguard. The fasteners are rotatable in a manner to urge the wedges against the ramped surfaces so the clamp and a corresponding clamp element clamp against a barrel to secure the handguard to it.

In one embodiment, the fasteners can extend in opposite directions across an axis of the handguard or the barrel, and can have reversed locking directions to distribute clamping forces to the barrel evenly. The clamp and wedges can prevent rotation of the handguard and provide parallel upward and downward movement.

In another embodiment, a fastener can extend through a wedge bore without engaging that wedge bore, while another fastener can threadably engage another wedge bore in the same wedge to provide horizontal wedge movement via rotation of the fastener. Multiple fasteners can engage different wedges on opposing sides of the barrel in this manner.

In still another embodiment, a first fastener including a first head can extend from a right side of the handguard to a left side of the handguard, while a second fastener including a second head can extend from the left side to the right side. The first head can be on the right side and the second head can be on the left side. The fasteners can be tightened from reverse directions and can move the respective wedges to which they are threadably mated in opposing directions, toward the longitudinal axis of the handguard.

In yet another embodiment, the clamp can include a lower surface that defines the contour of an upper surface of a barrel. The corresponding clamp element can engage a lower or opposing side of the barrel. When the fasteners are rotated, the wedges move toward one another and engage the ramped surfaces. In turn this can urge the clam and clamp element toward one another to clamp the barrel therebetween.

In even another embodiment, the clamp first and second ramped surfaces can be on opposite sides of the longitudinal axis. These ramped surfaces can be about 10 degrees to 50 degrees, inclusive, optionally about 30 degrees, declined from an upper surface of the clamp as the ramped surfaces transition away from the longitudinal axis. Corresponding wedges that slidably engage those surfaces can include corresponding angles.

In a further embodiment, the handguard includes a handguard upper part and a handguard lower part. The lower part is configured to extend below the barrel. The upper part is configured to extend above a gas tube of the barrel. The handguard upper part is fastened to the handguard lower part with secondary fasteners distal from the fasteners that engage the wedges.

In still a further embodiment, the wedges on opposite sides of the longitudinal axis can each include different holes. For example, the first wedge can include a first threaded hole to engage the first fastener so rotation of the first fastener moves the first wedge, and a second unthreaded hole such that the second fastener extending through it does not move the first wedge when the second fastener is rotated.

In still yet a further embodiment, the second wedge can include a first threaded hole to engage the second fastener so rotation of the second fastener moves the second wedge, and a second unthreaded hole such that the first fastener extending through it does not move the second wedge when the second fastener is rotated.

In a further embodiment, a method is provided of using the handguard. The method can include: placing a handguard under the barrel such that a left side and a right side of the handguard extend above the barrel; placing a barrel contour of a clamp adjacent the barrel, and such that a first ramped surface and a second ramped surface face away from a longitudinal axis of the handguard; extending a first fastener through a first wedge disposed adjacent the first ramped surface, through a second wedge adjacent the second ramped surface, and through the left side and right side of the handguard; engaging the first fastener so at least one of the first wedge and the second wedge engage at least one of the first and second ramped surfaces to urge a corresponding clamp element toward the clamp, whereby the barrel is clamped between the clamp and the corresponding clamp element to secure the handguard to the barrel.

The current embodiments of the handguard assembly and related method of the provide benefits in mounting a handguard to a weapon that previously have been unachievable. For example, where the handguard provides simple and efficient installation of it without use of a vice and tool, and without modification of the firearm. Where included, the upper part of the handguard is attached to the lower part of the handguard without any alignment issue. The handguard and its components also provide quick attachment to a barrel of the firearm without directly engaging the gas tube of the firearm located above the barrel. In turn, damage to the gas tube is prevented, along with any associated malfunction of the same. The handguard also is well suited to be applied to a variety of different modern weapons with straight profile barrels, such as the AK-47, HK-MP5, Bushmaster-ACR, IWI-Galil, CZ scorpion, Ruger PC carbine and variants thereof, as well as many other firearms.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
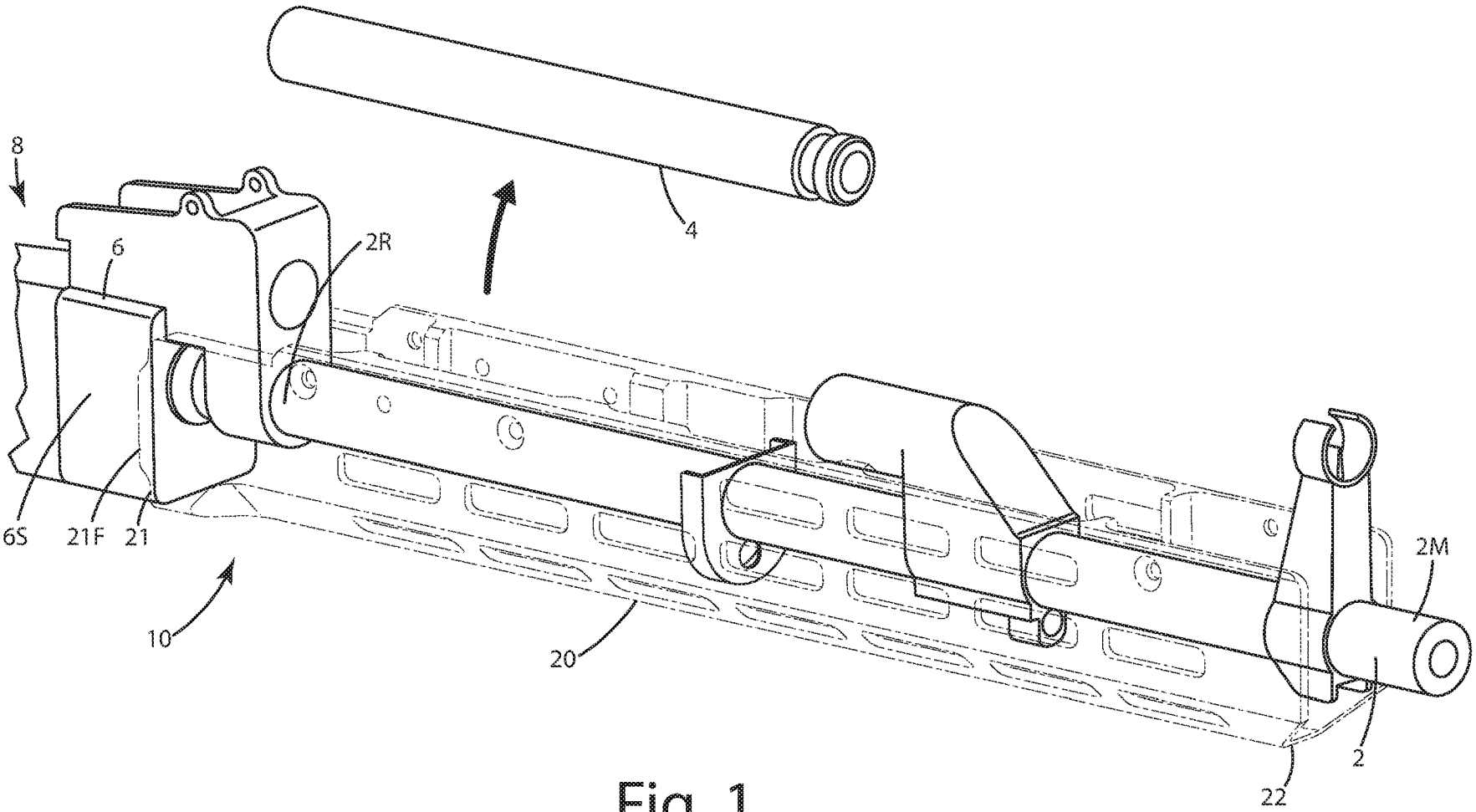
FIG. 1 is a side view of the handguard of a current embodiment, shown with a gas tube of a weapon removed and a lower part of the handguard being applied.

A current embodiment of the handguard is illustrated in FIGS. 1-7 and generally designated 10. The handguard 10 is configured to be secured over a barrel 2 and gas tube 4 extending from a receiver 6 associated with a weapon 8, such as a firearm. The weapon 8 can be a sporting, military or hunting rifle, for example an AK47, variants thereof and other firearm systems that include a barrel and a handguard. Other examples of modern weapons to which the handguard is suitable include those with a straight profile barrel, such as the HK-MP5, Bushmaster-ACR, IWI-Galil, CZ scorpion, Ruger PC carbine, and variants thereof, as well as others. The handguard 10 can include a lower channel shaped part 20 within which an upper barrel clamp 30 fits. The clamp 30 can interface with one or more wedges 40, such as the first wedge 41 and the second wedge 42 on opposite left L and right R sides of the longitudinal axis LA of the handguard 10 and weapon in general. One or more fasteners 50, such as the first fastener 51 and second fastener 52 can extend through the left side 20L and right side 20R of the handguard, in particular the lower part. These fasteners also can extend over the clamp 30 which can include corresponding first 31 and second 32 ramped surfaces that interface with the respective first 41 and second 42 wedges.

Figure 5:
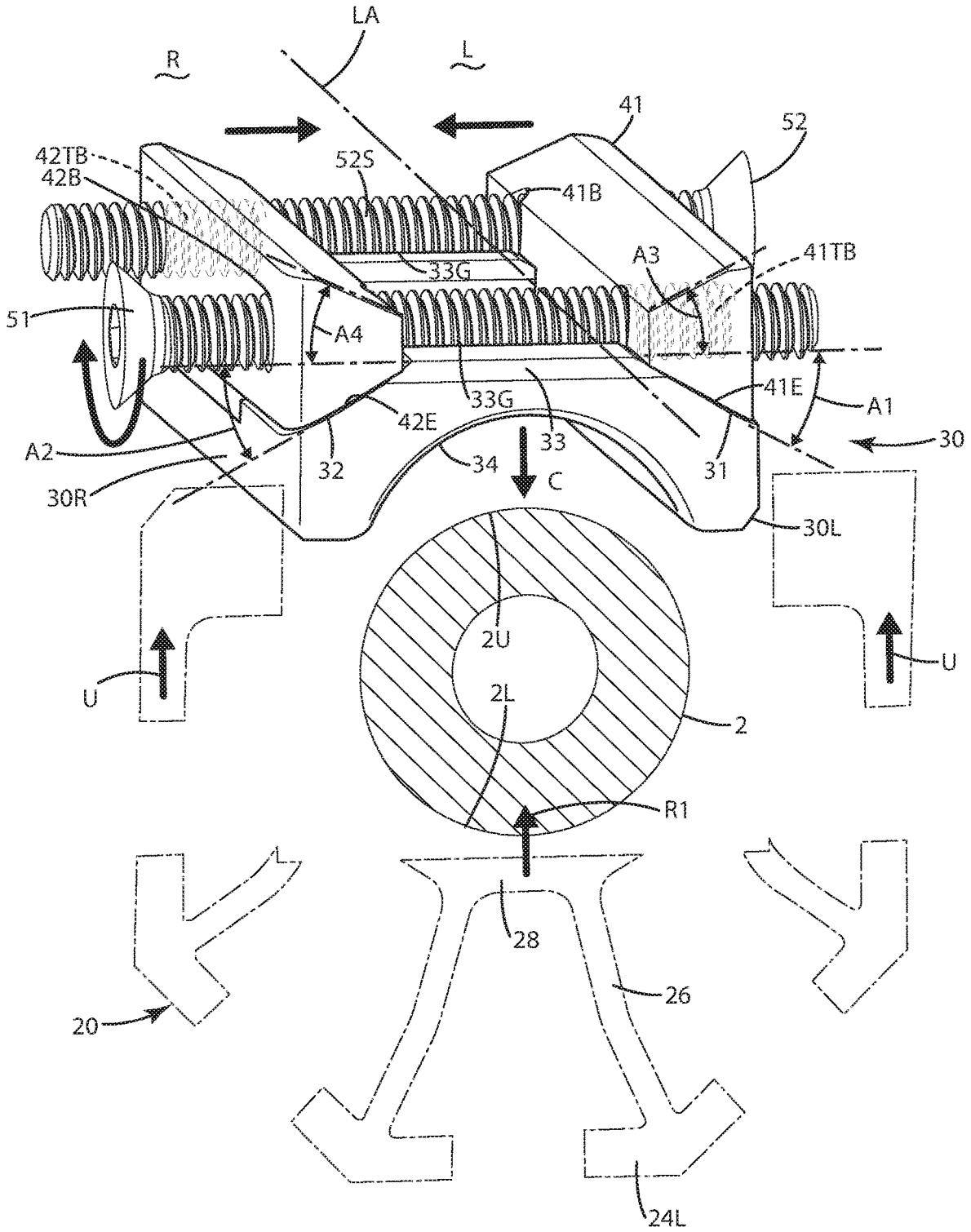
FIG. 5 is a view of the forces of the wedges and the clamp being distributed.

When the fasteners are rotated or otherwise tightened, the first fastener 51 moves the first wedge 41 as shown in FIG. 5 toward the second wedge or toward the longitudinal axis or plane LA, and the second fastener 52 moves the second wedge 42 toward the first wedge or toward the longitudinal axis or plane LA. In turn, the wedges slide or otherwise move along the respective ramped surfaces 31 and 32. The fasteners optionally can be in a reverse locking direction, which means one fastener moves one wedge in one direction, while the other fastener moves the other wedge in an opposite or different direction. Upon interaction with the ramped surfaces on the clam 30, the wedges 40 urge the clamp in direction C such that the barrel contour 34 engages the upper surface 2U of the barrel 2. This presses against the barrel. The fasteners, being attached to the handguard 10, thus urge the lower handguard part 20 upward in direction U. The barrel is clamped between the clamp 30 and the corresponding clamping element 28. As a result, the handguard lower part 20 can be nonrotatably secured to the barrel. The handguard upper part 60 can then be secured to the handguard lower part to complete the handguard. Optionally, the lower handguard 20 can be mounted to the barrel and weapon in general without the upper handguard 60 in place.

Turning now to FIGS. 1-6, the handguard and components of the weapon will now be described in further detail. The handguard 10 mounts over the barrel 2 of the firearm. The barrel 2 can include a muzzle end 2M and a receiver end 2R. The receiver end 2R can extend from the receiver 6. The handguard 10 can be constructed with a lower part 20 which is generally of a channel shape which fits around the barrel 2. The handguard lower part can include a rear or edge 21 and a muzzle end or front edge 22 that is distal from the rear 21. The receiver end 21 can engage the receiver 30 when the handguard is installed. The portion of the handguard near the rear edge 21 generally can be referred to as the receiver end of the handguard. The portion of the handguard or the front edge 22 can generally be referred to as the muzzle end of the handguard. The rear edge can optionally include a receiver flange 21F that extends beyond the remainder of the rear edge. The receiver flange 21F can overlap opposing sidewalls 6S of the receiver at least 1 mm, at least 2 mm, at least 3 mm, at least 5 mm, or other distances. This overlap of the sidewalls via the flanges, on opposite left and right sides of the handguard, can prevent or impair rotation of the handguard 10 relative to the receiver, in addition to the clamping action on the barrel 2 via the handguard as described below.

Figure 6:
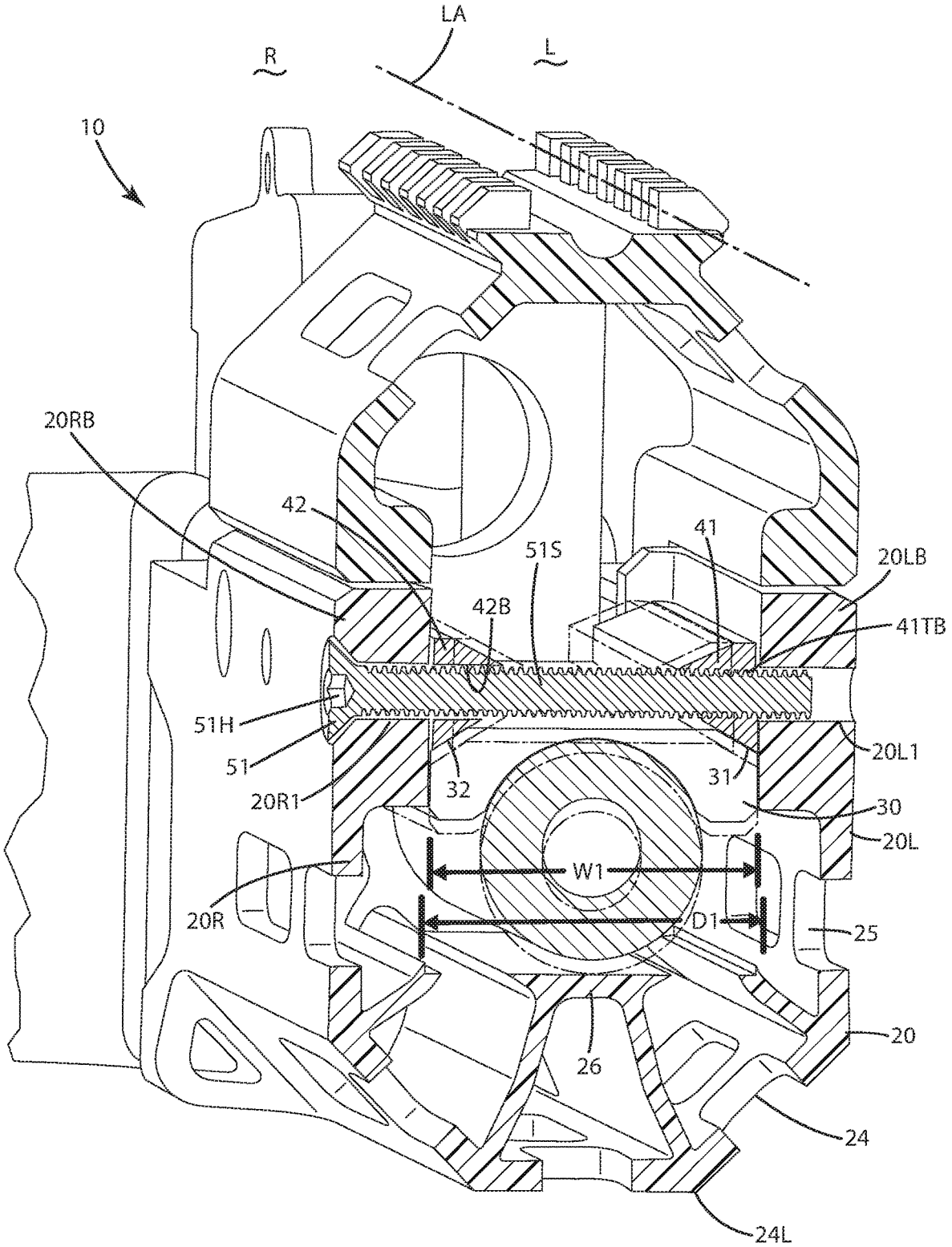
FIG. 6 is a partial section view of the handguard, clamp, wedges and first fastener.

The handguard shown in FIGS. 5-6 can include a handguard exterior 24 and a handguard interior 25. The handguard exterior 24 can include multiple surfaces, which optionally can form a contoured exterior surface for gripping by a user. As shown, that exterior surface can be a generally octagonal shape. A picatinny rail 24P can be disposed on a top portion of the handguard exterior 24. The handguard can also include the above noted longitudinal axis or plane LA dividing the handguard into left L and right R sides. These orientations, left and right are with reference to a user looking down the barrel B from the receiver end to the muzzle end of the barrel.

The handguard, and in particular the lower part 20, can include a left side 20L and a right side 20R. These left and right sides can include corresponding blocks 20LB and 20RB through which the first and second fasteners can extend and can be selectively threaded as described below. Where these blocks are located, the handguard can be greater in thickness than remaining portions of the handguard in other regions of the handguard. The handguard can define one or more holes or bores in the thread blocks. These holes or bores can be in a variety of configurations.

Figure 3:
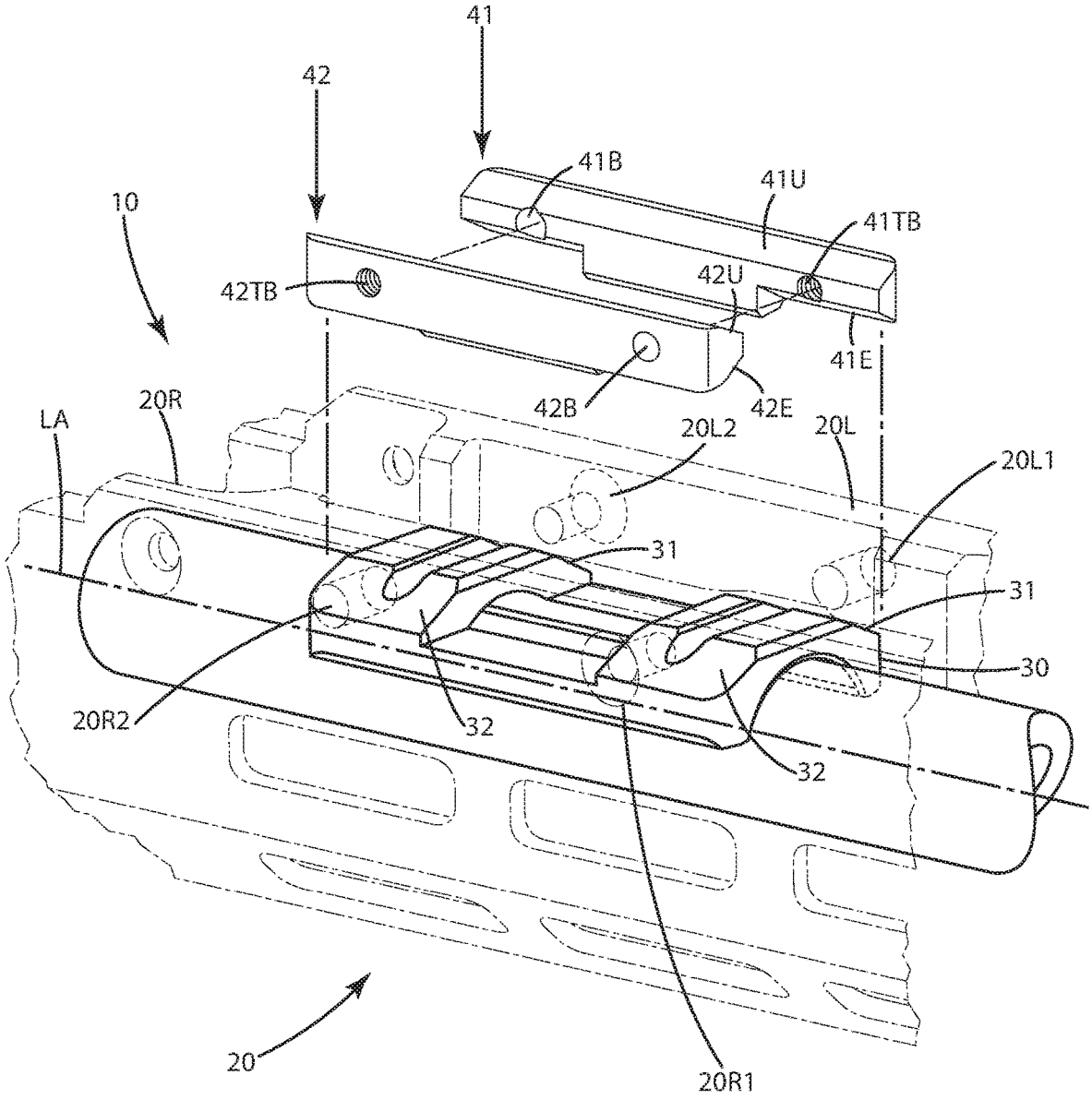
FIG. 3 is a close up of the handguard with opposing first and second wedges being placed adjacent the clamp, and adjacent sides of the handguard.

For example, as shown in FIG. 3, the multiple bores can be disposed on opposite lower parts of the handguard on opposite sides of the longitudinal axis or plane LA. There, the left side can define a first left side hole 20L1 and a second left side hole 20L2. The right side 20R can define a first right side hole 20R1 and a second right side hole 20R2. The first left side hole 20L1 can be threaded to threadably receive the threaded shaft 51S of the first fastener 51 as shown further in FIGS. 4 and 6. The first right side hole 20R1 however, might not be threaded, and can be simply a through hole through which the first fastener 51 and threaded shaft 51S extend without threadably engaging it. The second left side hole 20L2 might not be threaded and can be simply a through hole through which the second fastener 52 and threaded shaft 52S extend without threadably engaging it. The second right side hole 20R2 can be threaded to threadably receive the threaded shaft 52S of the second fastener 52 as shown further in FIG. 4. Optionally, the first right side hole 20R1 can include a shoulder or chamfer to receive a bugle head or tapered head 51H of the first fastener 51. Further optionally, the second left side hole 20L2 can include a shoulder or chamfer to receive a bugle head or tapered head 52H of the second fastener 52.

As shown in FIG. 5, the left and right sides 20L and 20R of the handguard 10, and in particular the blocks 20LB and 20RB can be separated by a distance D1. This distance D1 can be very closely matched to the width W1 of the clamp 30, optionally being less than 0.5 mm, less than 1 mm, less than 1.5 mm, less than 2 mm, less than 3 mm than the width W1 of the clamp to limit and/or prevent rotation of the of the clamped handguard 10 about the clamp and barrel upon installation. In particular, the side surfaces 30L and 30R of the clamp 30 can be placed in close proximity, optionally engaging, the thread blocks 20LB and 20RB such that the interaction of those surfaces prevents the rotation of the handguard relative to the clamp.

With reference to FIG. 6, the left and right sides of the handguard can transition to the lower wall 24L. A corresponding clamp element 26 can project upward from this lower wall. The clamp element 26 can be configured to engage the lower surface 2L of the barrel 2 when the clamp 30 is engaged sufficiently by the wedges 41, 42. The effect is that the lower wall and the clamp element 26 are raised upward in direction R1 shown in FIG. 5 when the wedges engage the clamp 30, due to the first and second fasteners passing through the respective left and right sides of the handguard. As a result, the barrel is clamped between the clamp 30 and the corresponding clamping element 26. Although shown as a relatively flat or planar plate, the corresponding clamp element 26 can be contoured to match the barrel profile, or angled or curved to properly engage that barrel and assist in the clamping action on it.

Figure 2:
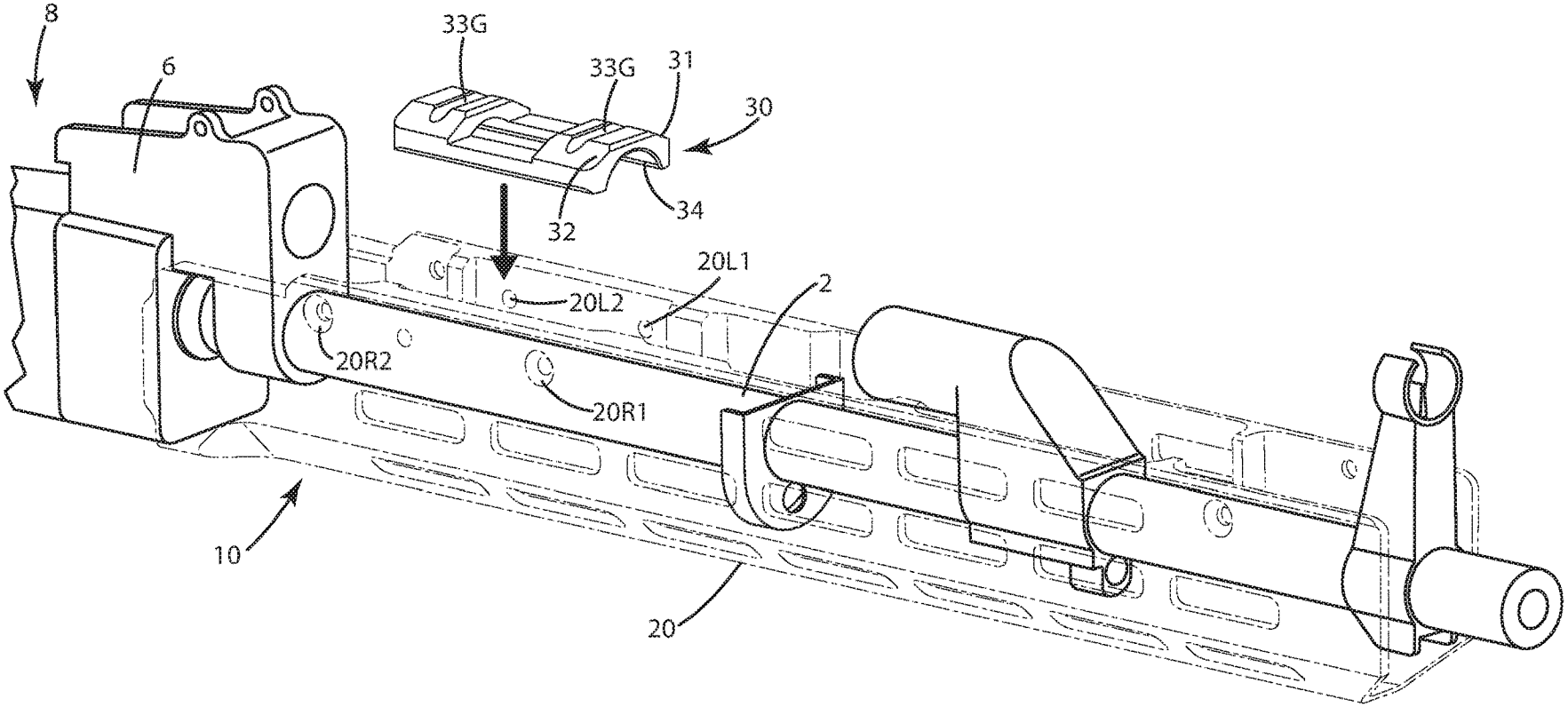
FIG. 2 is an exploded view of the handguard with a clamp being placed on a barrel between sides of the handguard.

The clamp 30 of the handguard can be seen in FIGS. 2, 5 and 6. That clamp is configured to fit over the top or upper surface 2U of the barrel 2. The clamp can include a barrel contour 34 that is designed to fit the barrel outer diameter contour to afford a close mating with that surface. Although shown as a partially cylindrical recess, that contour can be curved in an elliptical manner, angled, or of other complex shapes and contours depending on the barrel to which the clamp will be fitted. The clamp can include an upper surface 33 opposite the barrel contour. The upper surface can transition to the corresponding first 31 and second 32 ramped surfaces. These ramped surfaces can be downwardly declined or angled at an angle A1 and A2 relative to the upper surface on opposite sides of the longitudinal axis or plane LA. These angles A1 and A2 can be equal and optionally about 10 degrees to 50 degrees, inclusive, at least 10 degrees, at least 20 degrees, at least 30 degrees, or about 30 degrees declined from the upper surface of the clamp as the first ramped surface transitions from the upper surface to a left side surface 30L or 30R. Of course, other angles can be selected depending on the amount of movement desired by the wedges moving against those ramped surfaces. Optionally, the chamfers of the ramped surfaces or the angles A1 and A2 can be symmetric about the longitudinal axis or plane LA in many cases to provide nearly equal movement to the clamp on opposite sides of it, to thereby distribute forces generated by the wedges equally. Further optionally, the ramped surfaces can be disposed across the longitudinal axis LA from one another.

The upper surface 33 of the clamp 30 also can define one or more recesses or grooves 33G. These grooves can be configured to receive the first and second fasteners respectively through them. The fasteners optionally can extend above the upper surface 33 of the clamp while in the grooves. For example, part of the threads on the shafts of the fasteners can be located above or outside the grooves, while another lower part of the threads can be located in the grooves. Although only two grooves are shown, any number of grooves can be included, depending on the number of fasteners used in the handguard.

As mentioned above, the clamp interfaces with the first 41 and second 42 wedges. The first and second wedges can include wedge engagement surfaces 41E and 42E on their lower portions that are configured to slidably engage the respective first and second ramped surfaces 31 and 32 of the clamp. The wedge engagement surfaces can be chamfered or angled to the same angles A1 and A2 noted above. Of course, in some applications, these surfaces can be angled differently to provide a different type of clamping force.

As shown in FIG. 3, the wedges 41 and 42 also can include upper surfaces 41U and 42U. These surfaces can also be angled or chamfered at angles A3 and A4 respectively relative to the upper surface of the clamp. These angles can be symmetric about the longitudinal axis or plane LA, and can approximate the angles A1 and A2. In some cases, these surfaces can instead be flat, however, as shown they are chamfered or angled to provide clearance to the bottom of a gas tube 4 placed partially between them when the handguard is fully installed.

With reference to FIGS. 3-6, the wedges can include a system of bores. For example, the first wedge 41 can include a first threaded wedge bore 41TB sized to threadably engage the first fastener 51 and its shaft 51S, which extends transverse or perpendicular to the longitudinal axis or plan LA. This first threaded bore can be aligned with the first left side hole 20L1 and the first right side hole 20R1. The fastener 51 can extend through it and threadably engage that wedge bore 41TB. The second wedge 42 can include a corresponding second wedge bore 42B opposite the first threaded bore of the first wedge, but aligned with it. The second bore 42B can be unthreaded and of a larger size or diameter than the shaft of the first fastener 51 so that the shaft does not engage the second wedge to move it when rotated. Optionally, the threading and lack of threading can be reversed in the wedges, with the threads on the first fastener being a reversed thread. Further optionally, rotation of the first fastener and the second fastener urges the first wedge and the second wedge to slide along the respective first ramped surface and the second ramped surface such that the first fastener and the second fastener move away from the barrel as the wedges move toward the longitudinal axis.

The second wedge 42 can include a second threaded wedge bore 42TB sized the threadably engage the second fastener 52 and its shaft 52S, which extend transverse or perpendicular to the longitudinal axis or plan LA. This second threaded bore can be aligned with the second left side hole 20L2 and the second right side hole 20R2. The fastener can extend through it and threadably engage that bore 42TB. The first wedge 41 can include a corresponding first wedge bore 41B opposite the second threaded bore 42TB of the second wedge, but aligned with it. The first bore 41B can be unthreaded and of a larger size or diameter than the shaft of the second fastener 52 so that the shaft does not engage the first wedge to move it when rotated.

Figure 4:
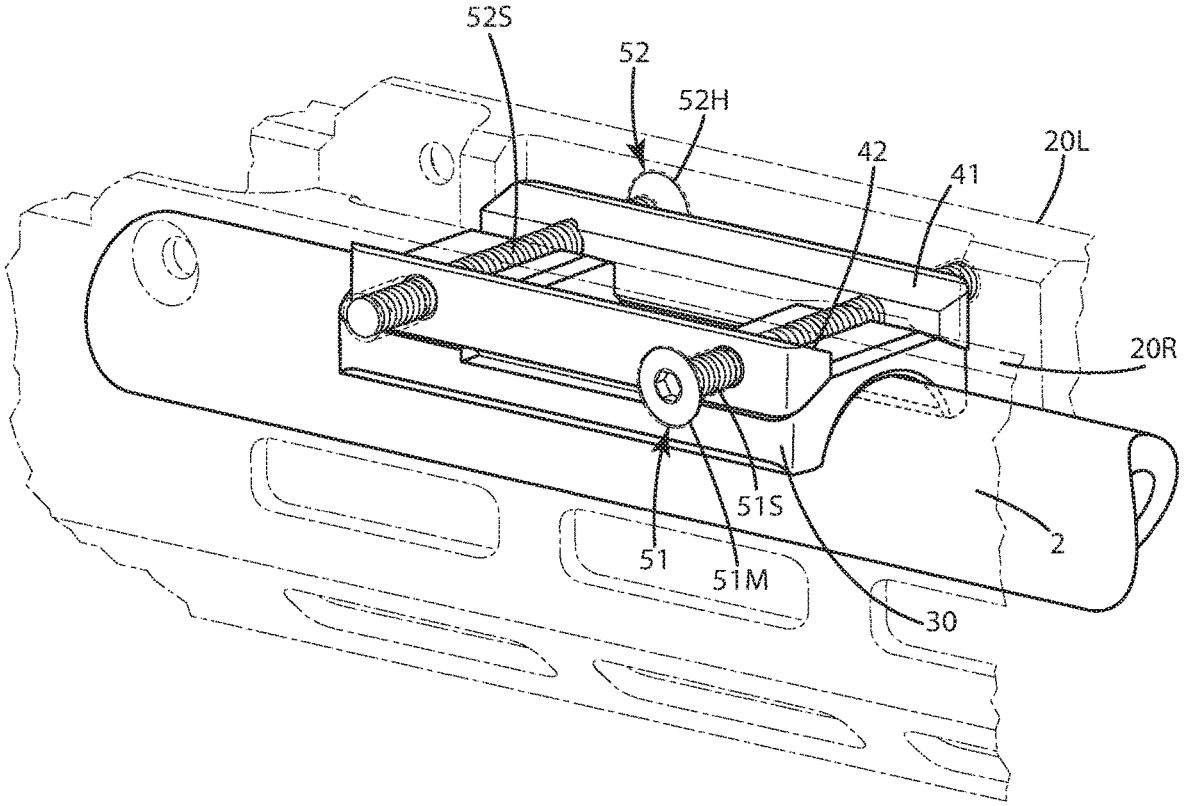
FIG. 4 is a close up view of first and second fasteners being placed through left and right sides of the handguard and through the first and second wedges.

Optionally, the first threaded bore 41TB can be threaded clockwise when viewed from the right side to the left side of the handguard, while the second threaded bore 42TB can be threaded clockwise when viewed from the right side to the left side of the handguard. With reference to FIGS. 4 and 5, the respective heads 51H and 52H of the fasteners can be disposed on and/or adjacent opposing right and left sides of the handguard, and can engage those respective parts of the handguard 10, optionally in chamfered recesses so the tops of the heads are flush with the exterior surface 24 of the handguard.

As can be seen from FIGS. 3-6, the fasteners and wedges provide a reverse locking direction. For example, the first fastener 51 when tightened moves the first wedge toward the longitudinal axis or plane LA by threadably engaging the first wedge, but not threadably engaging the second wedge. Thus, the first fastener does not move that second wedge directly. The second fastener, on the other hand, when tightened, moves the second wedge toward the longitudinal axis or plane LA by threadably engaging the second wedge, but does not threadably engage the first wedge. Thus, the second fastener does not move that first wedge directly. The respective fasteners accordingly move the wedges in opposite directions, and toward the other of the wedges independently. As a net result, however, the wedges bear against the respective ramped surfaces to urge the clamp downward in direction C as described below to clamp about the barrel 2. Further, the fasteners when tightened move the wedges so as to provide generally parallel up and down movement of the clamp from front to back of the clamp. In addition, the wedges move generally toward one another on the axes of each of the respective fasteners when those fasteners are tightened.

Figure 7:
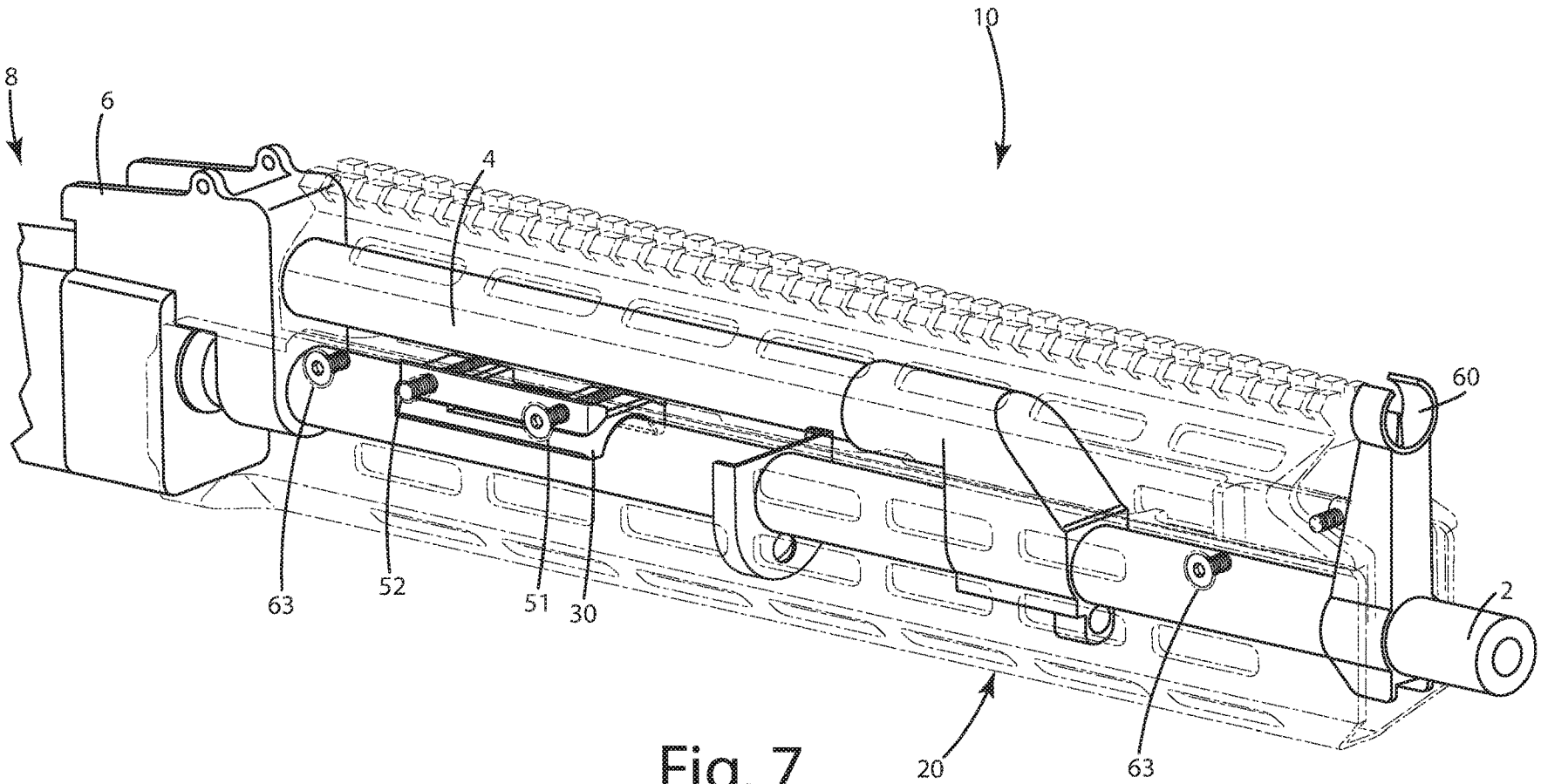
FIG. 7 is a perspective view of the handguard applied fully to the weapon.

As mentioned above, the handguard lower part 20 can be installed independently and fully to the barrel without the handguard upper part 60 being attached to it or the weapon. As shown in FIGS. 6 and 7, after the lower handguard 20 is clamped to the barrel, that upper handguard 60 can be installed. Of course, before installing it, the gas tube 4 can be installed over the clamp 30 and wedges 40. Those components do not engage or clamp against the gas tube as shown. The handguard upper part 60 can fit and extend above a gas tube over the barrel. That gas tube optionally can be cylindrical and can have a diameter of at least 10 mm. The handguard upper part 60 can be fastened to the handguard lower part 20 with secondary fasteners 63 distal from the first fastener 51 and the second fastener 52. Indeed, those secondary fasteners can play no role in fastening or securing the handguard to the barrel and weapon in general.

A method of installing the handguard 10 on a weapon will now be briefly described. To begin, this method can be used to install a handguard on a firearm having a barrel 2, a gas tube 4 above the barrel, and a receiver 6. The gas tube can be removed from the weapon as shown in FIG. 1. The lower handguard 20 can be placed adjacent the barrel 2, such that the barrel is disposed in its interior 25. The handguard can be placed under the barrel 2, but with the left side 20L and a right side 20R of the handguard extending above the barrel 2. As shown in FIG. 2, the clamp can be placed over the barrel 2. The barrel contour 34 of the clamp can be placed adjacent the barrel. The first ramped surface 31 and second ramped surface 32 face away from the longitudinal axis or plane LA of the handguard.

With the clamp placed, the first 41 and second 42 wedges can be placed adjacent the respective ramped surfaces 31 and 32. The first fastener 51 can be extended through the right side of the handguard, the second wedge disposed adjacent the second ramped surface, through the first wedge adjacent the first ramped surface, and through the left side of the handguard. That first fastener 51 can be rotated, for example clockwise, so the first wedge 41 engages and slides relative to the first ramped surface. The second fastener 52 can be extended through the left side of the handguard, the first wedge disposed adjacent the first ramped surface, through the second wedge adjacent the second ramped surface, and through the right side of the handguard. That second fastener 52 can be rotated, for example clockwise, so the second wedge 42 engages and slides relative to the second ramped surface. With the wedges moving toward the longitudinal axis or plane LA, they push against the ramped surfaces, which urges the clamp and its barrel contour against the barrel upper surface 2U. The wedges continue to move, and the fasteners engaging the handguard sides thus pull up on those sides, moving the corresponding clamping element against the lower surface 2L. Thus, the corresponding clamp element moves toward the clamp. As a result, the barrel is clamped between the clamp and the corresponding clamp element to secure the lower handguard 20 to the barrel.

After the first and second fasteners are installed fully, the handguard is restrained and/or impaired from rotating and/or moving longitudinally relative to the longitudinal axis and generally relative to the barrel. The optional flanges 21F engaging the receiver further help with the anti-rotation of the handguard. The gas tube 4 can be replaced on the receiver. The upper handguard 60 can be placed over the gas tube, and can partially overlap the lower handguard 60. Secondary fasteners 63 distal from the first and second fasteners can be installed to secure the upper handguard to the lower one and complete the installation. Of course, to remove the handguard from the weapon, the above steps can be reversed.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other wordsused to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A handguard assembly comprising:

a handguard defining a handguard interior, a handguard exterior, a receiver end, an opposing muzzle end, a right side and a left side, the right side defining a first right side hole, the left side defining a first left side hole;

a clamp including a lower surface defining a barrel contour configured to engage an upper surface of a barrel, the clamp including an upper surface and a first ramped surface;

a first wedge disposed adjacent the first ramped surface, the first wedge defining a first threaded wedge bore; and a first fastener extending in the first right side hole and the first left side hole, from the right side to the left side of the handguard, the fastener threadably engaging the first threaded wedge bore of the first wedge, whereby rotation of the first fastener urges the first wedge against the first ramped surface to thereby push the barrel contour against the barrel.

2. The handguard assembly of claim 1, comprising:

a longitudinal axis associated with the clamp and configured to align with the barrel;

a second ramped surface disposed across the longitudinal axis from the first ramped surface;

a second wedge disposed adjacent the second ramped surface, the second wedge defining a second threaded wedge bore;

a second fastener extending in a second left side hole and the second right side hole, from the left side to the right side of the handguard, the fastener threadably engaging the second threaded wedge bore of the second wedge, whereby rotation of the second fastener urges the second wedge against the second ramped surface to thereby push the barrel contour against the barrel.

3. The handguard assembly of claim 2, wherein the first fastener includes a first head located adjacent the left side of the handguard, wherein the second fastener includes a second head located adjacent the right side of the handguard.

4. The handguard assembly of claim 1, wherein the upper surface is planar, wherein the first ramped surface is about 10 degrees to 50 degrees, inclusive, declined from the upper surface of the clamp as the first ramped surface transitions from the upper surface to a left side surface of the clamp.

5. The handguard assembly of claim 1, wherein the clamp includes a first groove defined by the upper surface, wherein the first fastener includes a first shaft that passes through the first threaded bore and the groove, wherein the right side of the handguard defines a first right side bore through which the first fastener extends.

6. The handguard assembly of claim 5, wherein the handguard includes a corresponding clamp element that is disposed opposite the clamp when the barrel contour engages the barrel, wherein the corresponding clamp element is urged against a lower surface of the barrel when the barrel contour is urged against the barrel along an upper surface of the barrel.

7. The handguard assembly of claim 1,
wherein the handguard includes a handguard upper part and a handguard lower part,
wherein the handguard lower part is configured to extend below the barrel,
wherein the handguard upper part is configured to extend above a gas tube over the barrel, the gas tube having a diameter of at least 10 mm,
wherein the handguard upper part is fastened to the handguard lower part with secondary fasteners distal from the first fastener,
wherein the handguard upper part and handguard lower part are distal from the gas tube.

8. The handguard assembly of claim 1 comprising:
a second wedge opposing the first wedge, the second wedge slidably engaging a second ramped surface of the clamp opposite the first ramped surface.

9. The handguard assembly of claim 1,
wherein the first ramped surface and the second ramped surface are each angled downward relative to a clamp surface at an angle of between about 10 degrees to about 50 degrees, inclusive.

10. The handguard assembly of claim 1, comprising:
a second fastener having a second head and a second shaft, extending from the left side to the right side of the handguard,
wherein the second head is disposed adjacent the left side of the handguard,
wherein the first fastener has a first head and a first shaft,
wherein the first head is disposed adjacent the right side of the handguard.

11. A handguard assembly comprising:
a handguard having a longitudinal axis, a right side and a left side, the handguard defining a first right side hole, a second right side hole, a first left side hole and a second left side hole;
a clamp including a first ramped surface on the right side, a second ramped surface on the left side and a barrel contour configured to engage a barrel;
a first wedge disposed adjacent the first ramped surface on the left side;
a second wedge disposed adjacent the second ramped surface on the right side;
a first fastener extending in the first right side hole and the first left side hole, through the first wedge and;
a second fastener extending in the second right side hole and the second left side hole;
whereby rotation of the first fastener urges the first wedge against the first ramped surface, and rotation of the second fastener urges the second wedge against the second ramped surface, to thereby urge the barrel contour against the barrel and secure the handguard to the barrel.

12. The handguard assembly of claim 11,
wherein the handguard includes a corresponding clamp element configured to be disposed under the barrel, opposite the clamp,
wherein the rotation of the first fastener and the second fastener urges the first wedge and the second wedge to slide along the respective first ramped surface and the second ramped surface such that the first fastener and the second fastener move away from the barrel.

13. The handguard assembly of claim 11,
wherein the first fastener and the second fastener engage the left side and the right side of the handguard during rotation of the first fastener and the second fastener,
wherein the movement of the first fastener and the second fastener away from the barrel causes the first fastener and the second fastener to urge the corresponding clamp element to move toward a lower surface of the barrel to thereby cooperate with the clamp and clamp the barrel between the clamp and the corresponding clamp element.

14. The handguard assembly of claim 11,
wherein the clamp is disposed between the barrel and a gas tube of a firearm,
wherein the handguard includes a lower handguard part disposed under the barrel, the lower handguard part defining the first right side hole, the first left side hole, the second right side hole and the second left side hole,
wherein the handguard includes an upper handguard part disposed over the gas tube,
wherein the upper handguard is joined to the lower handguard part via a plurality of secondary fasteners distal from the first fastener and the second fastener.

15. The handguard assembly of claim 11,
wherein the first wedge defines a first threaded bore with which the first fastener threadably engages,
wherein the first wedge defines a second bore distal from the first threaded bore through which the second fastener extends without threadably engaging the second bore.

16. The handguard assembly of claim 11,
wherein the first fastener includes a first fastener head that engages the right side of the handguard,
wherein the second fastener includes a second fastener head that engages the left side of the handguard.

17. The handguard assembly of claim 11,
wherein the first wedge includes a first fastener bore and a second fastener bore distal from one another,
wherein the first fastener bore is threaded such that the first fastener threadably engages the first fastener bore to urge the first wedge toward the right side of the handguard while slidably engaging the first ramped surface,
wherein the second fastener bore is configured such that the second fastener does not threadably engage the second fastener bore.

18. A method of using a handguard assembly, the method comprising:
placing a handguard under the barrel such that a left side and a right side of the handguard extend above the barrel;
placing a barrel contour of a clamp adjacent the barrel, and such that a first ramped surface and a second ramped surface face away from a longitudinal axis of the handguard;
extending a first fastener through the right side of the handguard, a second wedge disposed adjacent the second ramped surface, through a first wedge adjacent the first ramped surface, and through the left side of the handguard;
engaging the first fastener so at least one of the first wedge and the second wedge engage at least one of the first and second ramped surfaces to urge a corresponding clamp element toward the clamp,
whereby the barrel is clamped between the clamp and the corresponding clamp element to secure the handguard to the barrel.

19. The method of claim 18 comprising:
removing a gas tube from a position adjacent a barrel of a firearm before the placing a handguard step;

replacing the gas tube into the position adjacent the barrel after the engaging step;

placing an upper handguard part adjacent a lower handguard part of the handguard, the upper handguard part extending over the gas tube; and securing the upper handguard part to the lower handguard part with a plurality of secondary fasteners, each secondary fastener shorter than the first fastener.

20. The method of claim 19 comprising:

extending a second fastener through the first wedge disposed adjacent the first ramped surface, through the second wedge adjacent the second ramped surface, and through the left side and right side of the handguard;

wherein a first head of the first fastener and a second head of the second fastener are on opposite left and right sides of the handguard.

* * * * *